US006358405B1

(12) United States Patent
Leahy

(10) Patent No.: US 6,358,405 B1
(45) Date of Patent: Mar. 19, 2002

(54) POLLUTANT INTERCEPTOR

(76) Inventor: Brian Warren Leahy, 11 Twentysecond Avenue, Sawtell, NSW, 2452 (AU)

( * ) Notice: Subject to any disclaimer, the term of this patent is extended or adjusted under 35 U.S.C. 154(b) by 0 days.

(21) Appl. No.: 09/486,994

(22) PCT Filed: Aug. 28, 1998

(86) PCT No.: PCT/AU98/00701

§ 371 Date: May 15, 2000

§ 102(e) Date: May 15, 2000

(87) PCT Pub. No.: WO99/11878

PCT Pub. Date: Mar. 11, 1999

(30) Foreign Application Priority Data

Sep. 3, 1997 (AU) ..... P09296
Nov. 19, 1997 (AU) ..... PP3703

(51) Int. Cl.[7] ..... B01D 17/12

(52) U.S. Cl. ..... 210/85; 210/86; 210/90; 210/97; 210/121; 210/162; 210/170; 210/459

(58) Field of Search ..... 210/86, 87, 90, 210/97, 121, 122, 123, 154, 162, 163, 164, 170, 448, 452, 459, 460, 130, 248, 85, 94

(56) References Cited

U.S. PATENT DOCUMENTS 5,562,819 A * 10/1996 Turner et al. ..... 210/162
5,980,740 A * 11/1999 Harms et al. ..... 210/162
5,985,157 A * 11/1999 Leckner et al. ..... 210/162
6,086,756 A * 7/2000 Roy ..... 210/162
6,214,216 B1 * 4/2001 Isaacson ..... 210/162

* cited by examiner

*Primary Examiner*—Joseph W. Drodge
(74) *Attorney, Agent, or Firm*—Michael Best & Friedrich, LLC

(57) ABSTRACT

An apparatus for interception solid matter from fluid flowing through a drain or pipe including a drain or pipe coupling to receive and direct fluid flow netting to intercept solid matter while permitting fluid to pass through, and a netting release that interacts with the netting and the coupling to automatically release the netting when a predetermined amount of solid matter has been intercepted.

20 Claims, 10 Drawing Sheets

POLLUTANT INTERCEPTOR

FIELD OF THE INVENTION

The present invention relates to apparatus for intercepting solid matter from a fluid flowing through a drain, pipe or the like. For example, the apparatus can be used for intercepting waterborne solids in waste wasters, such as storm water run-off, industrial waste waters etc. The invention will be primarily described with reference to these latter applications, although it should be appreciated that the invention is not so limited, and can find application wherever the interception of solid matter from flowing fluids is required.

BACKGROUND ART

A major problem in the release and directing of waters into the natural water course is the inclusion of solid matter, which ultimately ends up in the sea and rivers and acts as a pollutant to marine life, beaches and to humans.

Further, the dealing with storm water run-offs and the inclusion of water-borne solid pollutants is emerging as one of the greater environmental challenges in the current era.

It is extremely difficult to prevent solid matter from ultimately finding its way to waste waters, storm water run-off etc, and therefore it would be desirable if solid matter could be removed prior to such waters returning to the natural water course.

Pollutant interceptors are relatively new in the art. Existing pollutant interceptors are known to be subject to fouling and failure. The present invention has been developed in this context.

SUMMARY OF THE INVENTION

The present invention provides apparatus for intercepting solid matter from a fluid flowing through a drain, pipe or the like, the apparatus including:

coupling means adapted for association with an outlet of the drain, pipe or the like and for receiving and directing fluid flowing thereout;

netting means adapted for intercepting the solid matter in the directed fluid and arranged with the coupling means such that the directed fluid can pass through the netting means; and netting release means that is adapted for interacting between the netting means and the coupling means to enable release of the netting means from the coupling means when a predetermined amount of solid matter has been intercepted.

Apparatus according to the invention can be employed to easily and economically filter out water-born solids from fluids such as industrial waste waters, storm water, etc. Should the apparatus be filled or become fouled etc., activation of the netting release means allows the apparatus to continue to release fluid from the apparatus, ie. so that blockages, back pressure etc. are not introduced, and which may have even more severe environmental impact. Also, the netting means can be readily detached, serviced and/or replaced periodically.

In a particularly preferred mode of operation, typically the netting means is periodically serviced, emptied, cleaned etc. so that the netting release means may not even need to come into operation during actual use of the apparatus.

When the terminology "drain, pipe or the like" is employed in this specification, it includes any type of drainage, whether open or enclosed, conduits, tubes, fluid flow pathways etc.

Preferably, and as a result of restricted fluid flow caused by intercepted solids, the netting release means is activated for release of the netting means from the coupling means when, in the apparatus:

(i) a predetermined, level of fluid is reached;

(ii) a predetermined pressure of fluid is reached;

(iii) a predetermined mass of solid matter is reached; or (iv) the flow of fluid via the netting means is reduced to a predetermined level.

Thus, the apparatus can be configured such that one or more of these factors can be used to activate the netting release means.

Preferably the netting release means is activated by a trip mechanism associated with the coupling means which: in (i) is activated by the rise of a float; in (ii) and (iii) is activated by a mechanical, electronic or electrical sensor; and in (iv) is activated at a level of fluid flow as recorded by a flow meter. Thus, a variety of "triggering" type arrangements can be employed to sense when a parameter has reached a predetermined level.

Preferably the netting release means includes a retaining cable means that can extend around an outer periphery of the coupling means and releasably clamp an end of the netting means to the coupling means, wherein the cable means is released when the trip mechanism is activated. Thus, a simple means for attaching the netting means to the coupling means can be provided. In this regard, when the terminology "cable means" is employed, any cable, clip, clamp, chain, rope, cord-like or tape-like device (or combinations thereof) is envisaged (such as stainless steel cable, synthetic or natural fibrous ropes, stainless steel chain, plastic woven tapes, hose-type clamp mechanisms, C-shaped leaf spring clips, or combinations thereof etc).

Preferably the cable means is looped around and attached to the periphery of an opening to the netting means and is adapted, when the netting means is released from the coupling means, to act as a drawstring to close the opening (eg. whilst the netting means remains in a stream of fluid flowing through the apparatus).

Preferably the netting means is a net bag and is additionally attached to the coupling means by a safety cord or chain. Preferably the safety cord is attached to the coupling means at one end, and is attached to the cable means at the other. Preferably the attachment of the safety cord to the cable means is via a ring through which the cable means extends (ie. so that the ring can be moved along the cable means). Thus in use, the pulling of the cable means on the safety card can cause the opening of the netting means to be closed (in eg. the drawstring-like manner).

Preferably in (i), the float is retained within a riser pipe and, at a predetermined level of fluid, rises to a height in the riser pipe wherein a mechanical release device is activated, which in turn releases the netting means from the coupling means.

Typically the mechanical release device includes a pivot arm mounted at one end to the coupling means for pivoting thereabouts and being adapted at the opposite end for engagement by a catch mechanism that is part of and is released in the mechanical release device, and wherein the cable means is released from the coupling means when the pivot arm is allowed (ie. released) to move away from the catch mechanism.

Preferably the cable means is an endless loop and is looped around the pivot arm.

In alternative configurations, the electronic or electrical sensor, or a controller associated with the flow meter can interact with the mechanical release device to release the pivot arm from the catch.

Typically, the coupling means receives essentially all fluid leaving the drain, pipe or the line. Preferably the coupling means is a squat cylinder adapted for direct attachment to and/or fitting over the outlet end of a correspondingly shaped pipe, tube or drain. The coupling means can be attached to the pipe etc. by welding, bolting screwing, riveting, adhesive, etc. However, any other suitable type of mechanism for attaching or positioning the coupling means to or near an outlet of fluid flow can be employed.

The coupling means can also be provided with a diversion outlet through which fluid can be directed once a predetermined amount of solid matter has been intercepted by the netting means. Thus, as a fail-safe mechanism where the netting release means for some reason is not activated, fluid can still be released from the apparatus via the diversion outlet.

In one form the diversion outlet can be a diversion pipe that is selectively closed to fluid flow by an associated valving mechanism (eg. a butterfly or plate is valve), wherein the valving mechanism is opened once the predetermined amount of solid matter has been intercepted by the netting means, to then release fluid via the diversion pipe. Alternatively, in a simpler variation, the diversion outlet can be provided in the form of a diversion weir or outlet passages formed in the coupling means and which are adapted for allowing an overflow of fluid to be released from the apparatus once a predetermined fluid level has been reached in the apparatus due to a blockage at or a filling of the netting means.

Apparatus in accordance with the present invention can, accordingly, prevent a drain etc., when provided with an interceptor apparatus, from becoming blocked (eg when there is an inordinate or excessive amount of solid matter in the fluid stream, such as in a torrential downpour of rain). Also, the preferred arrangement of the safety cord enables the intercepted solid matter to be retained, and the drawstring action of the bag traps the solid matter for subsequent disposal, rather than it simply being re-entrained within the flowing fluid.

BRIEF DESCRIPTION OF THE DRAWINGS

Notwithstanding any other forms which may fall within the scope of the present invention, preferred forms of the invention will now be described, by way of example only, with reference to the accompanying drawings in which.

MODES FOR CARRYING OUT THE INVENTION

Figure 1:
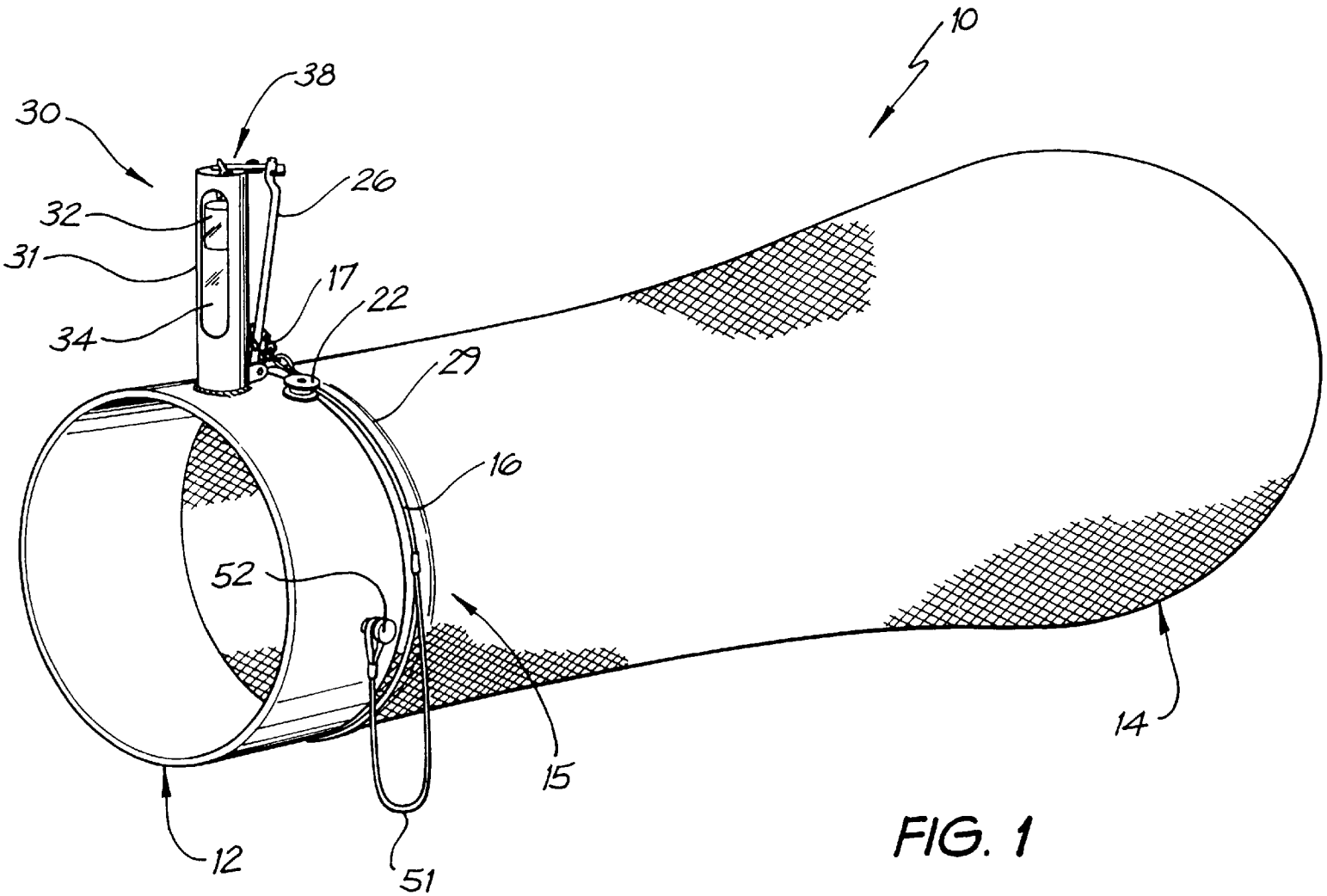
FIG. 1 shows a perspective view of a first variation of a solids interceptor in accordance with the present invention.
Figure 2:
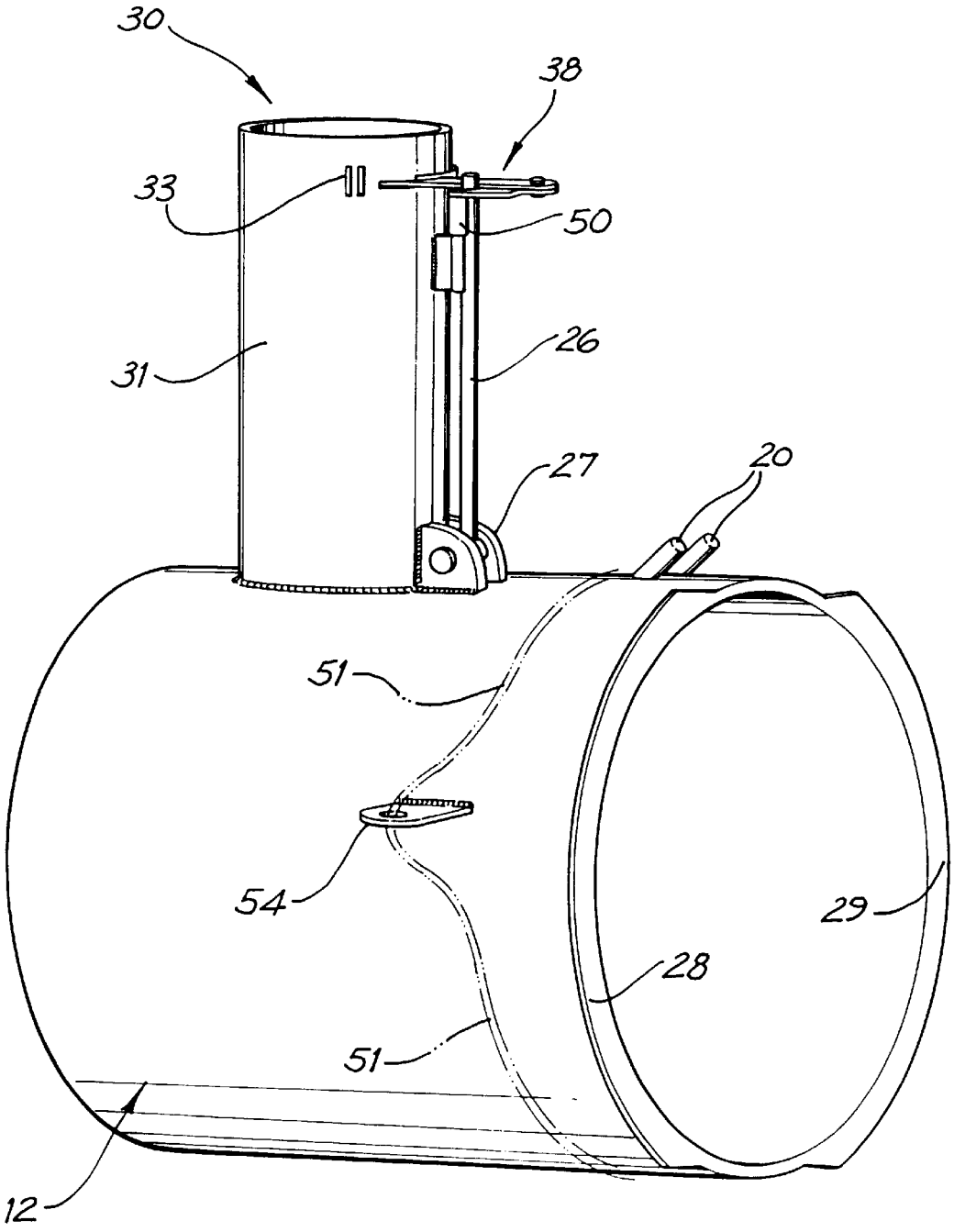
FIG. 2 shows a perspective view of a second variation of a preferred solids interceptor in accordance with the present invention.

Referring to FIGS. 1 and 2, apparatus for intercepting solid matter from a fluid is shown in the form of a waterborne solids interceptor 10. The interceptor includes a coupling means in the form of pipe section 12 which can be fitted over, attached to or positioned near the end of a pipe, tube, drain outlet or the like. Pipe section 12, of course, can be any suitable shape depending on the shape and nature of the outlet from which fluid is being released. The pipe section can be formed from any corrosion resistant material, such as galvanised welded steel, stainless steel, injection moulded plastic etc.

The interceptor 10 shown in FIG. 1 (a similar arrangement would be employed for the interceptor of FIG. 2) further includes a netting means in the form of a net bag 14. The bag has an open end 15 that is releasably attached to the pipe section 12. The bag is typically formed from a corrosion resistant material, such as a stainless steel wire, wire mesh or from any rot resistant natural or synthetic fibre material (eg. polypropylene, polyester etc). The open end 15 of the net bag is secured around the external periphery of the pipe section 12 by a continuous loop of cable 16 (described in greater detail below) and which is looped through the end of the bag to be retained to the same. Again, the cable is typically formed from suitable corrosion resistant materials, including stainless steel or steel alloy cables (typically plastic coated), or from synthetic rope etc.

The cable 16 extends fully around the pipe section circumference, and is of a length such that it can be tensioned (described below) to clamp the open end of the net between the cable and the pipe section 12, and can be detensioned to release the same.

Figure 3:
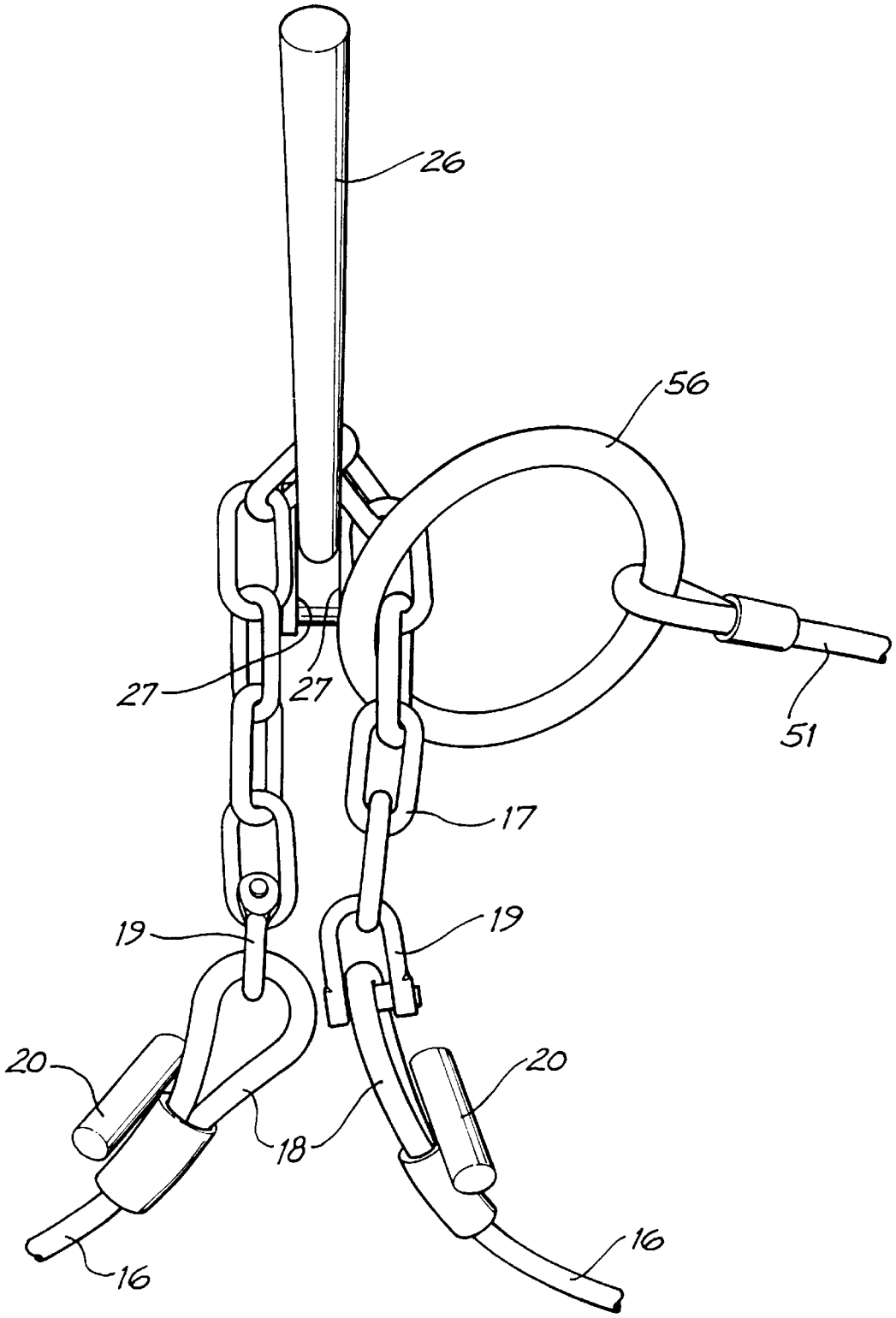
FIG. 3 shows a perspective detail of a preferred release mechanism that can be employed with the apparatus of FIGS. 1 and 2.

As better seen in FIG. 3, the cable 16 includes a section of chain links 17 which is attached at each end to loops 18 of the cable via releaseable shackles 19. In FIG. 2 the loop ends 18 of the cable 16 extend between a pair of upstanding pins 20 formed on the pipe section 12 (shown also in FIGS. 11 and 13) The pins 20 provide a simple cable guiding arrangement.

Alternatively, as shown in FIG. 1, the cable 16 can extend between a pair of pulleys 22 (FIG. 1) mounted on the external surface of the pipe section. The pulley arrangement enables each end of the cable to be guided smoothly during tensioning and detensioning of the cable.

The chain link section 17 is looped around a pivot arm 26 which enables subsequent tightening of the cable (described below). The pivot arm is attached to the pipe section at bearing plate 27.

The secure fastening of the net bag 14 to pipe section 12 can be further facilitated by providing outwardly flared lips 28, 29 (see FIG. 2) around part of the pipe section, and against which the cable 16 can be tensioned to enhance secure fastening of the net bag, and to prevent the cable from being easily displaced (slipped) off the pipe section in use.

FIGS. 1 and 2 in addition show a vertical riser pipe assembly 30, which is mounted on the pipe section 12, and is in fluid communication with the interior thereof. The riser assembly is part of a mechanism to release arm 26 at a predetermined time/occurrence in operation of the interceptor. Release of arm 26 releases net bag 14 (described below).

The riser pipe assembly includes vertical float chamber 31, in which a float 32 moves upwardly and downwardly. A hinge bracket and closure tab 33 (FIG. 4) for a chamber lid (not shown) is also provided. A view window 34 can be provided in one side of the float chamber (FIG. 1) to enable a user to check that the float has not become fouled (eg. clogged or entangled) during use.

The lower end of the float chamber communicates with the pipe section via an inlet, and the upper end of the float chamber is provided with a catch assembly 38, which is activated by the float as it moves towards the top of the float chamber.

Referring now to FIGS. 4 to 10, it will be seen that the catch assembly 38 includes a catch 40 that is pivotally mounted in a bracket 41, which in turn is bolted to the interior of float chamber 31. The catch is adapted to engage an arm 42 which is part of pivot arm engaging assembly 43 (see FIG. 10).

Figure 4:
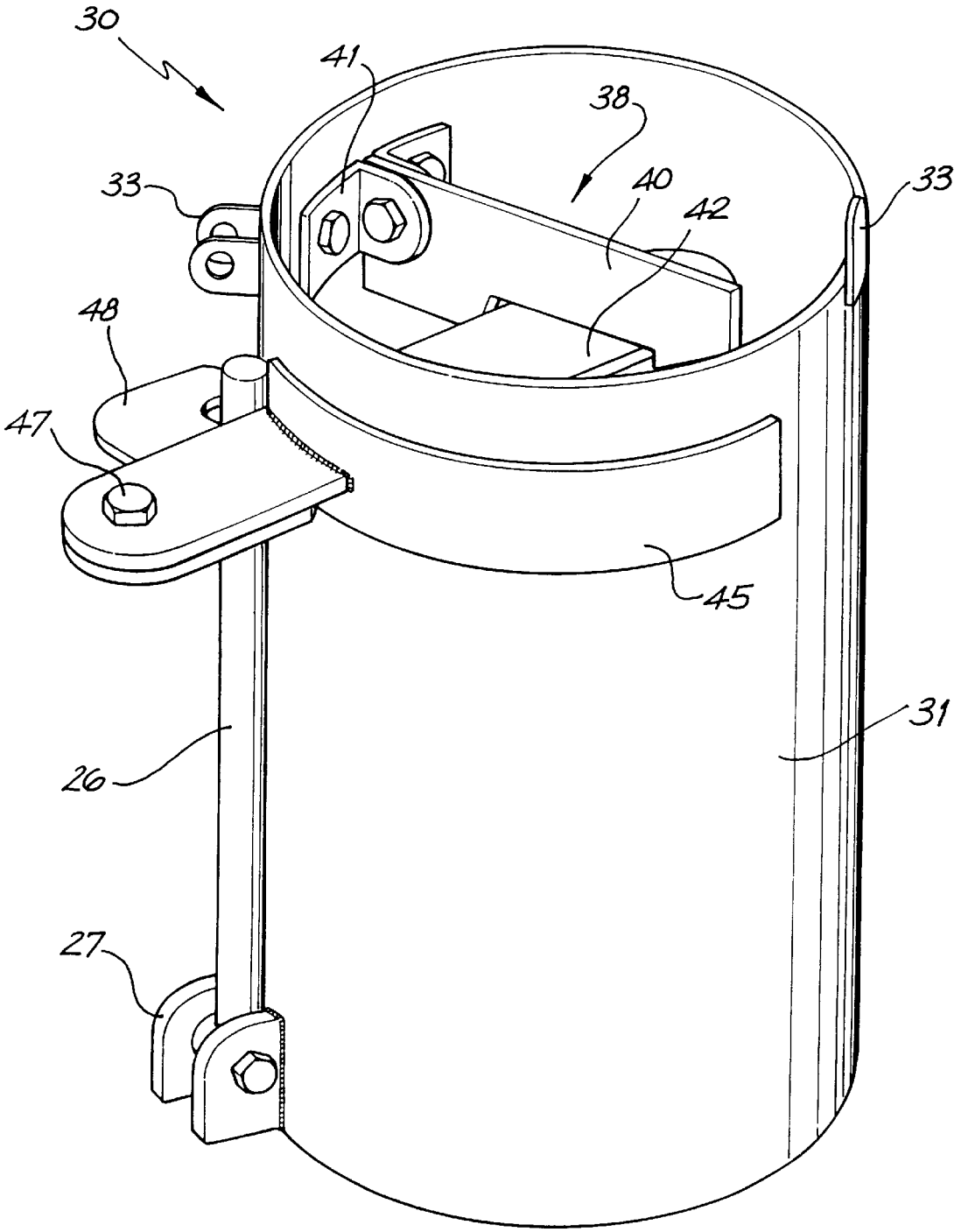
FIG. 4 shows a perspective detail of a preferred type of float activated mechanical release mechanism for use with the device of FIG. 2.
Figure 5:
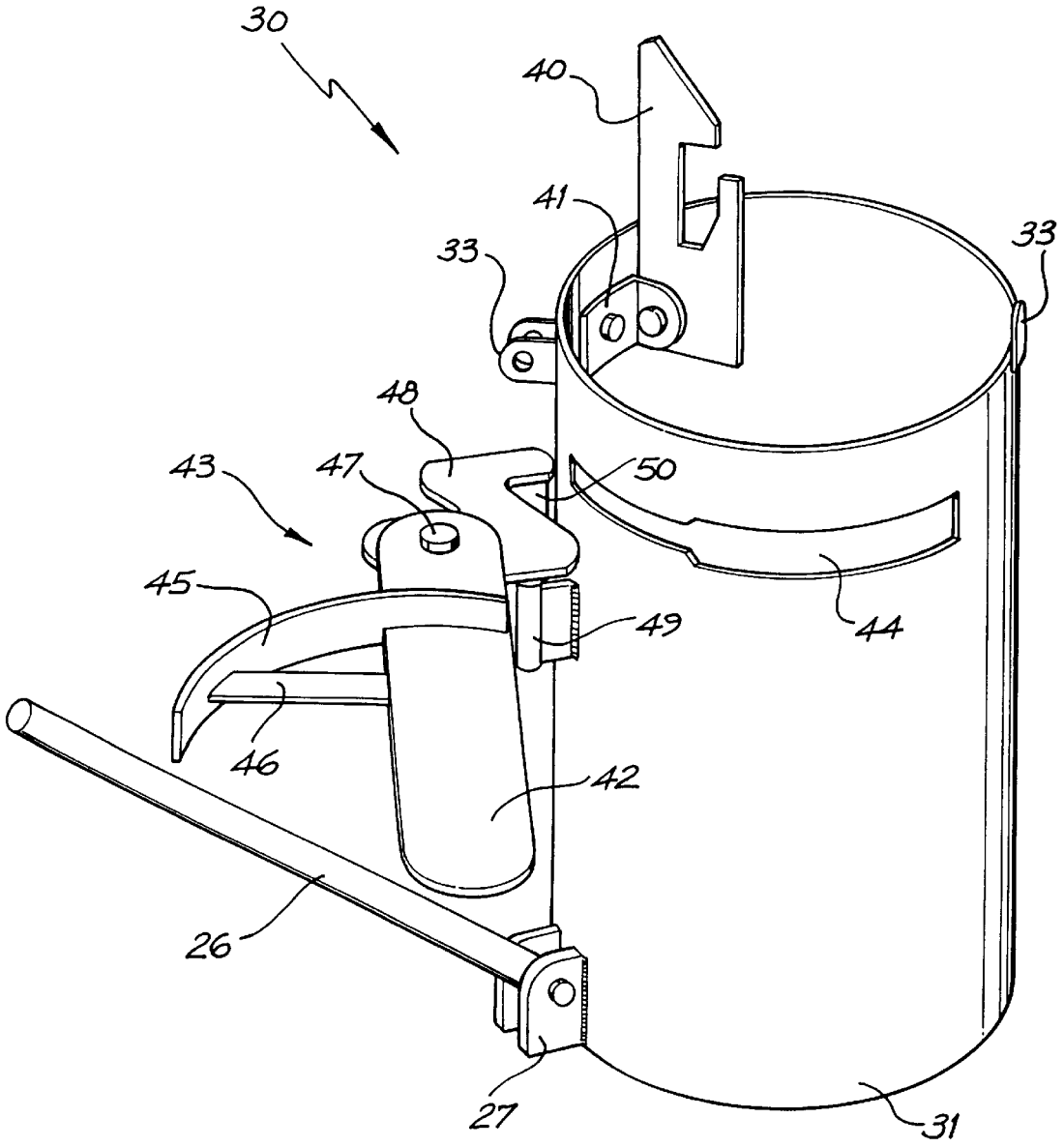
FIG. 5 shows the release mechanism of FIG. 4 in a released orientation.
Figure 7:
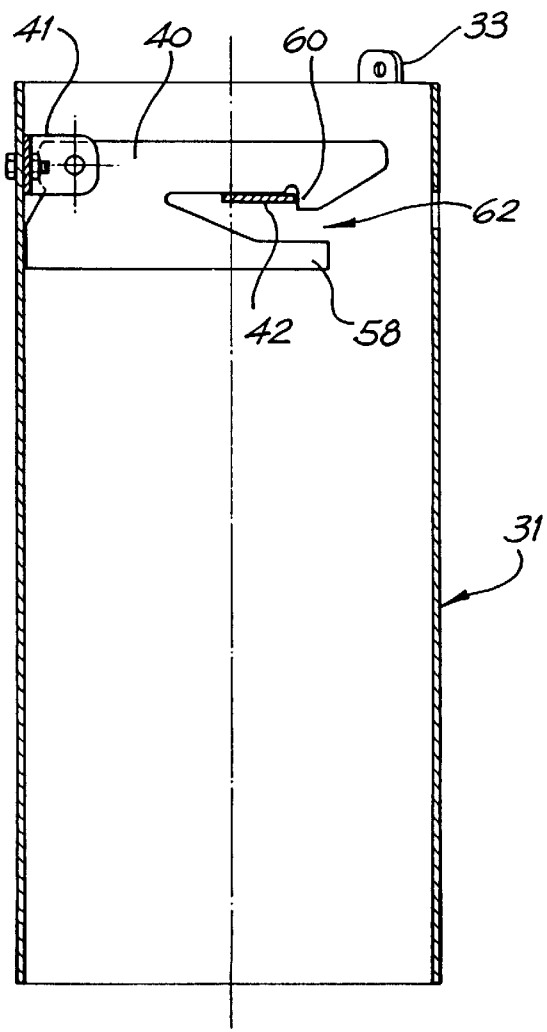
FIG. 7 shows a sectional side elevation of the release mechanism of FIG. 4 (being a view in the same orientation to FIG. 6)
Figure 6:
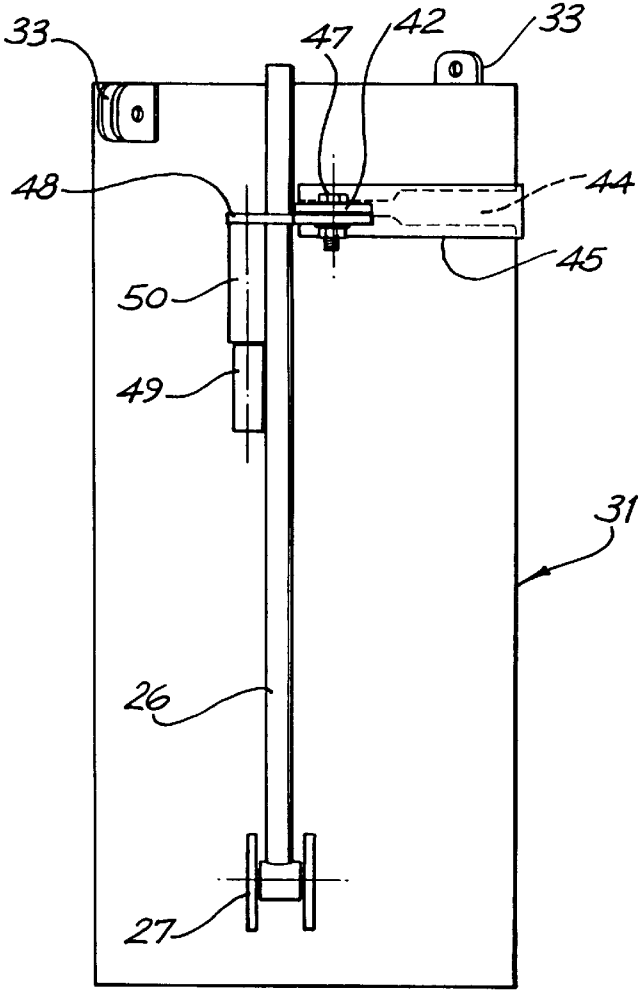
FIG. 6 shows a side elevation of the release mechanism of FIG. 4.

As can be seen in FIG. 4, the arm 42 extends into the interior of chamber 31, and also extends externally thereof through chamber slot 44 (FIG. 5). Attached to arm 42 is a curved support plate 45 which abuts the external face of float chamber 31 in use (FIG. 4) to set the arm extension distance. A finger support 46 extends from curved plate 45 to arm 42, and ensures that the arm is supported and remains reasonably rigid in use.

The opposite end of arm 42 is pivotally mounted (eg. via a bolt 47) to a catch plate 48, which functions as a catch for pivot arm 26. The catch plate 48 is generally S-shaped, and has an integral pin 49 that extends downwardly therefrom in use. The pin 49 is received in a bush 50 attached to the external surface of chamber 31 and is supported for rotation in the bush in use.

Figure 8:
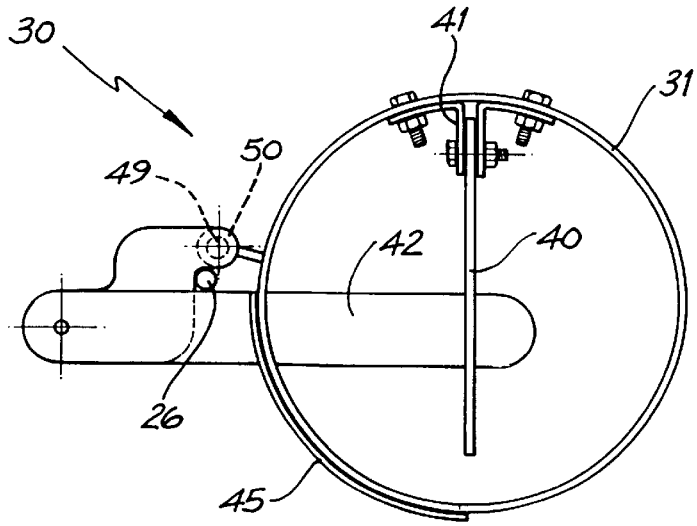
FIG. 8 shows a plan elevation of the release mechanism of FIG. 4.
Figure 9:
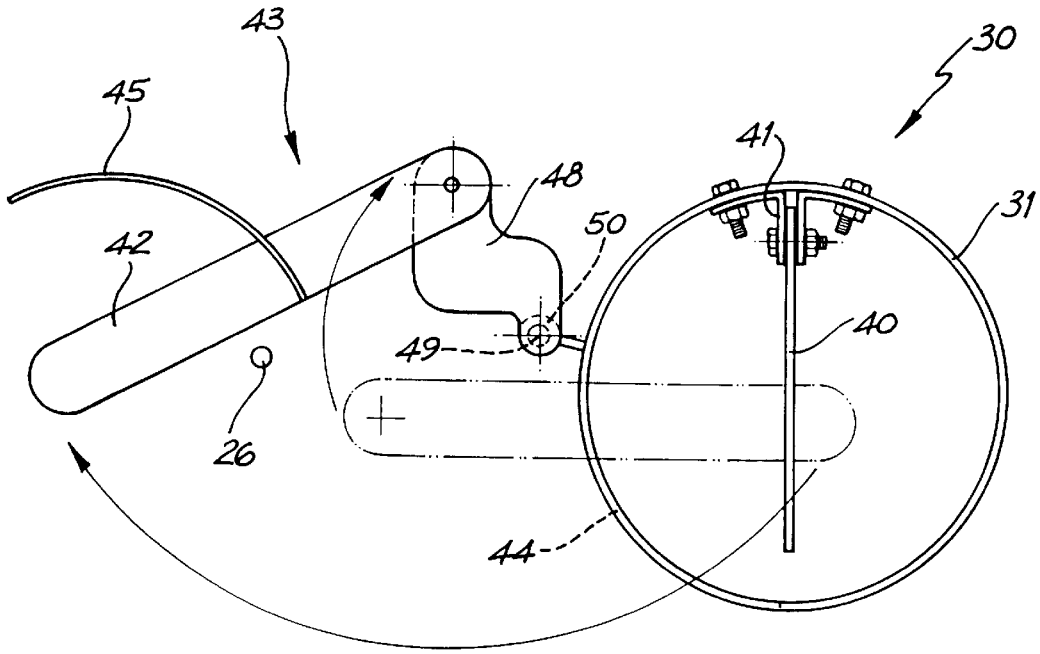
FIG. 9 shows a similar view to FIG. 8 but with the release mechanism in a released orientation.
Figure 10:
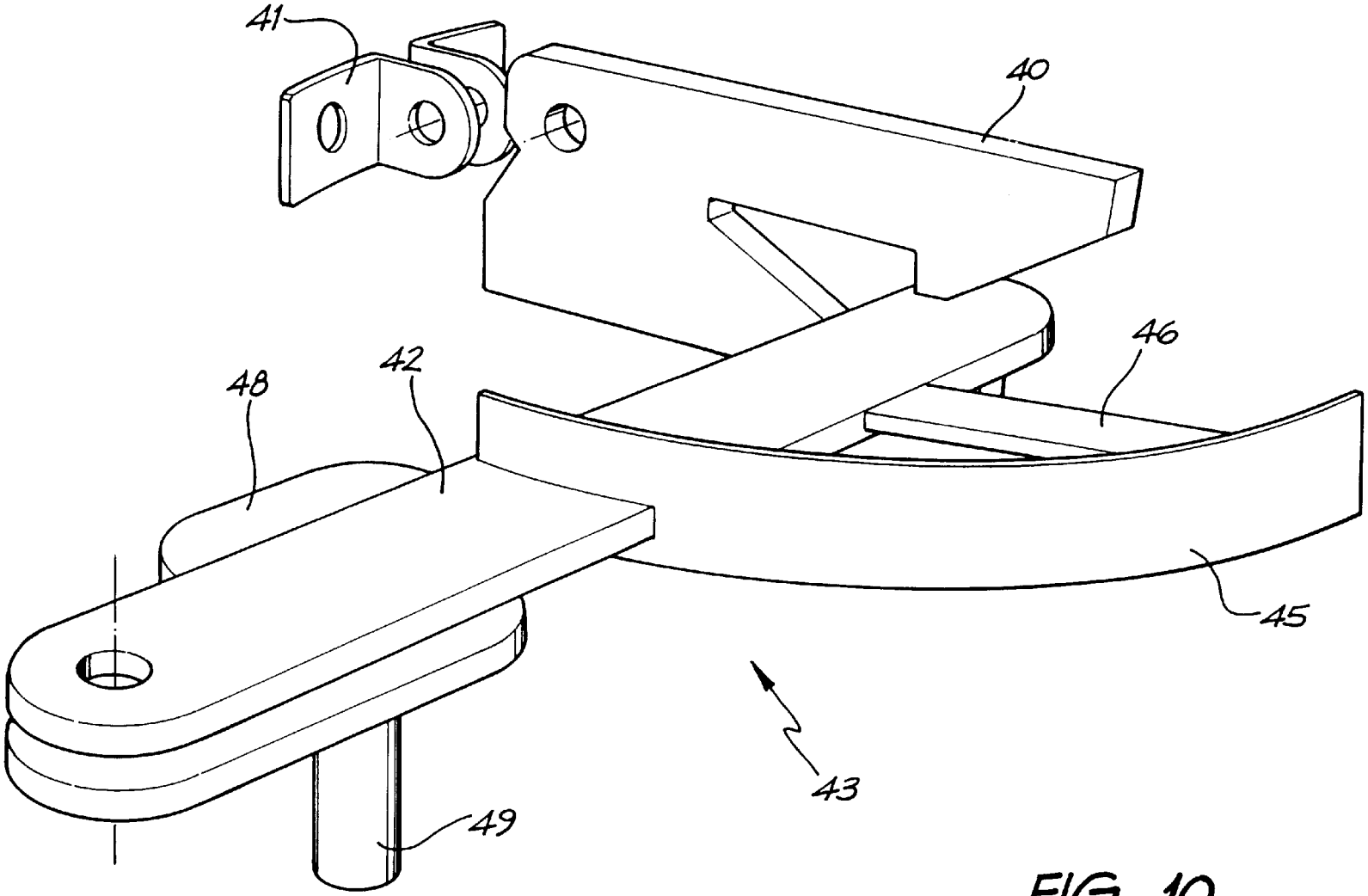
FIG. 10 shows a perspective view of some of the components of the release mechanism of FIG. 4.

Referring to FIGS. 8 and 9, FIG. 8 shows the catch assembly in an "engaged" position wherein the pivot arm 26 is captured by catch plate 48 (and thereby tensions cable 16 described below). In addition, arm 42 is captured within catch 40 to prevent its movement.

FIG. 9 shows the catch assembly in a released configuration wherein catch 40 has been caused to release arm 42 (eg. by the engagement thereagainst of float 32). Thus, because pivot arm 26 is urged outwardly by the force in cable 16 (ie. due to tension therein to retain the net bag on pipe section 12 in use), the catch assembly is forced to pivot outwardly. Firstly catch plate is caused by arm 26 to pivot about pin 49 (ie. pin 49 rotates in bush 50) and thence arm 42 is caused to pivot about the support plate 45 at bolt 47). Eventually the catch assembly is pivoted sufficiently out so that the pivot arm 26 is completely released therefrom add falls downwardly. This releases cable 16 from arm 26.

Thus, because cable 16 is looped around arm 26 and is selected to be of a specific length, when the arm 26 is captured (in the "engaged" position), the cable is tightened, and therefore the net bag open end 15 is clamped by the cable to the pipe section 12. However, once the pivot arm is released for pivoting, then the cable is loosened and can move (slide) off arm 26 so that net bag open end 15 is no longer clamped. The flowing fluid passing through the interceptor then causes the net bag to become detached from the pipe section 12.

Typically a retention (or safety) cord 51 is attached to the cable 16 at the open end of the net bag. In the arrangement of FIG. 1, one end of the cord is attached to a fixture 52 arranged externally on the pipe section 12.

In the arrangement of FIGS. 2 and 3, the retention cord 51 includes two such sections of cord which extend from lug 54. These two sections are illustrated schematically in dotted outline in FIG. 2. Each end of this cord is attached to a ring 56 (see FIG. 3), and through which the cable 16 (or link section 17) extends. The ring on the upper section of retention cord 51 is, as shown in FIG. 3, attached to link section 17, whereas the ring for the lower cord 51 is attached to cable 16.

The use of a pair of rings enables the end of the net bag to be gathered and hung (ie. by suspending the bag from cord 51). In addition, cord 51 is typically attached to the lug 54 by a releaseable mechanism (eg. a shackle arrangement).

As described above with reference to FIG. 2, the outwardly flared lips 28 and 29 extend only part way around the circumference of the open end of pipe section 12 (ie. the loops are discontinuous at the top and bottom of that open end). This discontinuity of the lips enables the ring 56 and chain link 17 located at the upper end of the pipe section, and the ring 56 located at the lower end of the pipe section to pass easily off the pipe section when the net bag is released in use. It will also be seen that the pins 20 are sloped outwardly (FIG. 2) so that the chain section 17 and ring 56 do not become snagged thereon.

In either arrangement, once the neg bag has been released, the retention cord prevents it from being washed away. Also, to detach the bag from the interceptor before emptying, replacement etc., a user simply needs to detach the retention cord at fixture 52/lug 54, and the user can then lift the bag via the retention cord.

Also, when the net bag is released from pipe section 12, the cord 51 acts on cable 16 to cause it to function as a drawstring and close the open end of the net bag under the pressure of the fluid flowing through the interceptor. Thus, solids intercepted within the net bag are safely retained within the bag once it has been released from pipe section 12. As described above, the net bag can then be detached, and the solids emptied, prior to the net bag being re-attached to the pipe section for re-use. Optionally, and if necessary, the net bag can be washed, cleaned and/or repaired.

In use, with the net bag attached to the pipe section as described above, and the catch assembly in the engaged configuration, as storm water passes out of a drain, pipe or the like and into pipe section 12, it is directed into the net bag (FIG. 1) and any debris, solid matter, etc. which is larger than the pores of the net bag is trapped therein. Progressively, over time the net bag fills up. If it occurs that the net bag is not timely emptied or serviced, then the neg bag capacity may be completely filled, substantially or entirely restricting the flow of fluid out of the net bag. This then causes an increase in bag pressure, and, for example, during a storm, water then progressively fills up pipe section 12. Once the pipe section has been filled, the water level then rises further into vertical rise pipe assembly 30, acting on float 32 and causing it to rise within the float chamber 31. Eventually the float engages against the underside of catch 40 (ie. at arm 58 FIG. 7).

The float continues to rise and lifts catch 40 upwardly causing it to pivot at bracket 41. Shoulder 60 of the catch then moves out of abutment with arm 42, and arm 42 is then urged to move away from the catch through gap 62. The pivot arm engaging assembly is therefore freed, and the force against pivot arm 26 (ie. from the tension in cable 16 and chain link 17) causes the pivot arm to be pivoted outwardly about bearing plate 27. Thus, the entire engaging assembly 43 is caused to pivot outwardly (ie. as shown in FIG. 9).

Eventually, the pivot arm 26 moves sufficiently downwards (ie. ultimately laying down against the pipe section 12 and between pins 20) so that the chain link 17 is freed from the pivot arm (ie. slides thereoff), and thus the cable 16 is loosened. This loosening enables the cable 16 and the bag end to be freed from and pass over the flared lips 28, 29 and thus the bag is freed from the pipe section 12.

Further movement of the bag tensions the retention cord 51, and via rings 56, causes it to pull against cable 16. Thus, the drawstring bag closure of cable 16 is induced. With the end of net bag closed solids are captured therein and are prevented from dispersing (and re-entering into the storm water, waste water, etc.). As described above, the net bag can later be detached from lug 54 and emptied and replaced, or replaced with a fresh bag, etc.

The movement of the pivot arm 26, and therefore the release of the catch assembly, can be automated. For example, the catch assembly can be released when a pressure or fluid sensor detects a predetermined pressure or fluid level within the solids interceptor (ie. as a result of the net bag having been filled by solids the fluid level and pressure would build up in section 12 and this could easily be sensed). Alternatively, when the flow drops to a predetermined level, then a flow meter positioned either within the interceptor or externally thereof (ie. downstream of the interceptor) can activate the catch assembly to release the pivot arm.

In a further alternative, an electronic weight sensor that senses the weight of solid matter in the net bag when that bag is filled up with solid matter can be employed to activate the catch assembly for release of the pivot arm. Thus many types of release mechanisms are possible.

Figure 11:
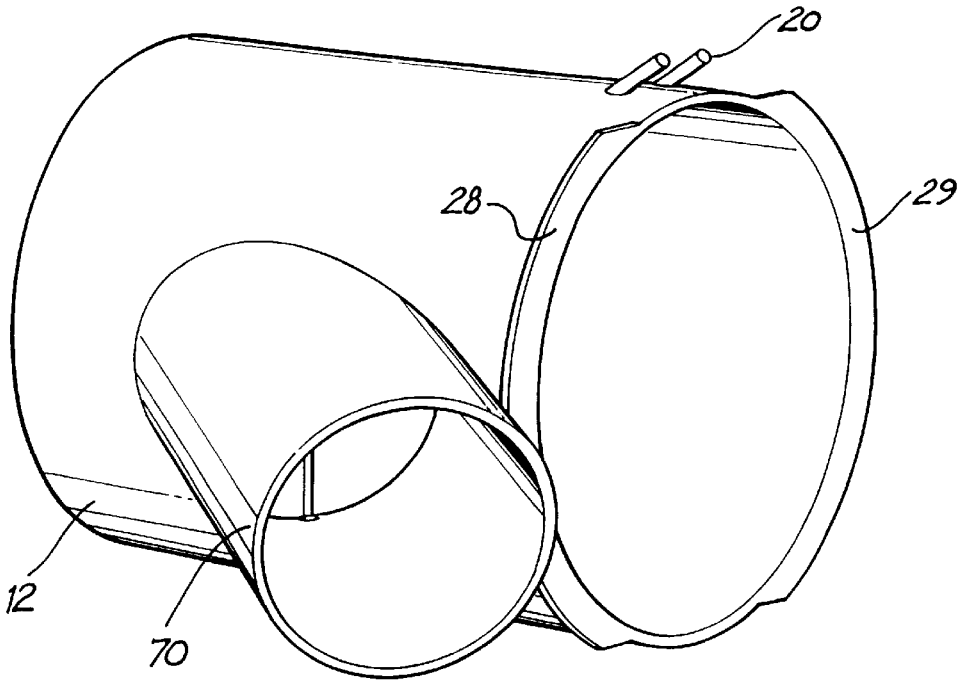
FIG. 11 shows a perspective view of part of a diversion system for use in apparatus in accordance with the present invention.
Figure 12:
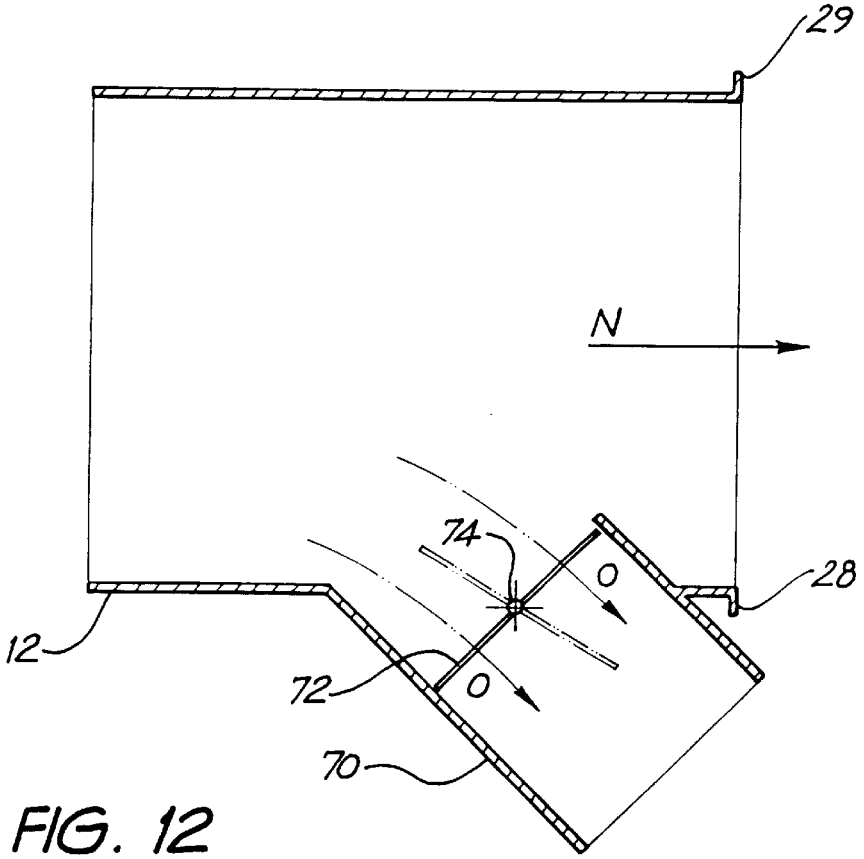
FIG. 12 shows a schematic sectional plan elevation through the apparatus of FIG. 11.

Referring now to FIGS. 11 and 12 (where like reference numerals will be used to denote similar or like parts), a diversion outlet is shown in the form of an offtake pipe 70. In the arrangement of FIG. 11, the vertical riser pipe assembly 30 has been removed. The offtake pipe provides a backup mechanism should the vertical riser pipe assembly fail to release the net. The offtake pipe 70 is open to flow of fluid through the pipe section 12, save for the arrangement of a plate valve 72 therein. The plate valve is typically closed (shown as an unbroken line in FIG. 12), but can be opened to enable a fluid flow thereabouts (indicated by dotted arrows O) by pivoting the plate valve around a pivot axis 74 (supported by appropriate bearings in the offtake pipe).

In use, fluids (eg. storm water, waste water etc.) flows normally through the pipe section 12 (in the direction of arrow N) and pass into the net bag to intercept solid matter. However, once the flow of fluid has been stopped (eg. due to the net bag's filling up) or has been reduced to some predetermined level, or the back pressure has built up etc., then plate valve 72 can be opened (eg. moved to the position shown in dotted outline). Thus, fluid is then allowed to bypass the blockage (at the normal opening of the pipe section), and damage to the interceptor apparatus and back pressure problems, etc. are prevented.

The opening and closing of the plate valve can be mechanically, electro-mechanically, or even manually controlled. For example, the plate valve can be opened by a mechanical arrangement not dissimilar to the vertical riser pipe assembly but in which case the moving pivot arm 26 (or the like) would open the valve, rather than release the net.

Figure 13:
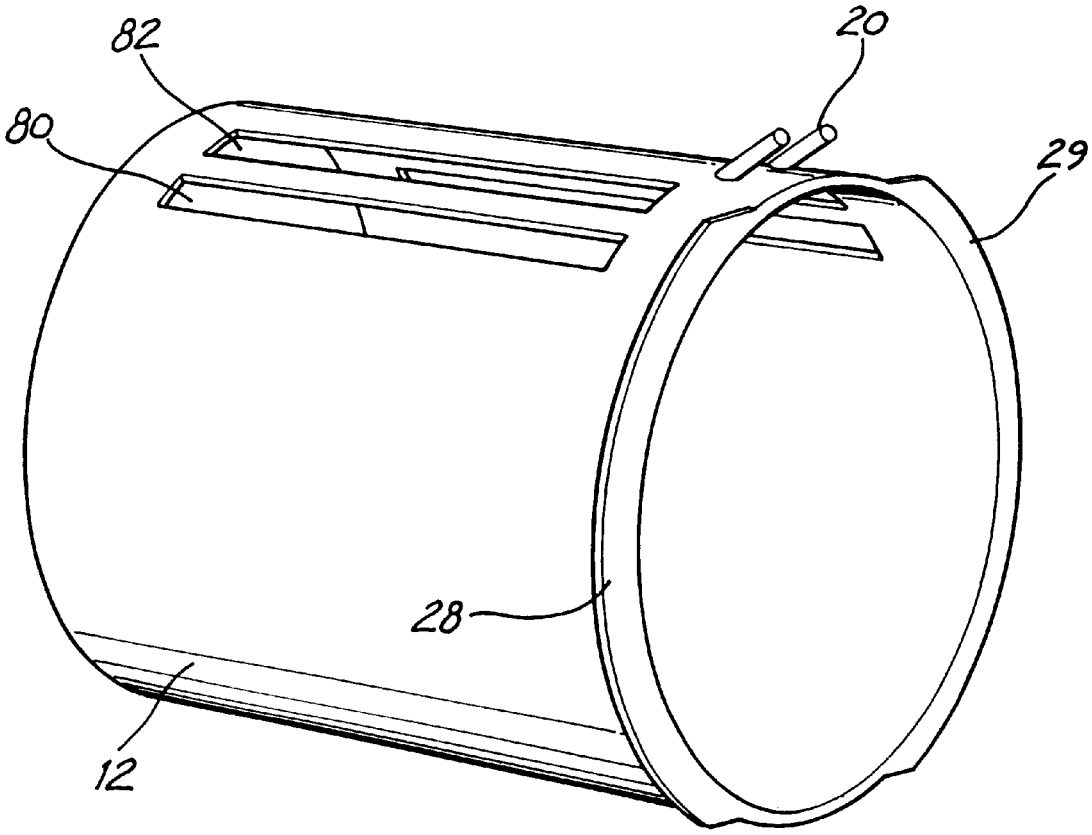
FIG. 13 shows a perspective view of part of a further alternative diversion system for use in apparatus in accordance with the present invention.

Referring to FIG. 13, where like reference numerals will be used to denote similar or like parts, a further alternative diversion outlet will now be described. In the arrangement of FIG. 13, a diversion outlet in the form of overflow vents 80, 82 is provided. In this case, the vents arc permanently open and rising fluid level in pipe section 12 simply spills out of vents 80, 82 when it reaches the height of those vents. A similar pair of vents can be provided on the opposite side of the plate section (as shown). The vents can be provided in conjunction with the offtake pipe arrangement 70 of FIGS. 11 and 12 (if necessary) or can co-operate with internal weirs which enable a spillover of fluid at certain levels. The vents can also be used in conjunction with the vertical riser pipe assembly 30, although in this case the pipe assembly would need to extend downwardly and into the pipe section to a level below the lowest vent, and the mechanism that activates the catch may need to be engaged at a level that is below that of the lower most vent. Again, the overflow vents provide a backup mechanism should the vertical riser pipe assembly fail (or become clogged or fouled etc.).

Preferred construction materials for the interceptor components include stainless steel, galvanised steel (being cheap and readily available) for the pipe section and catch assembly, injection moulded plastics, again being cheap and readily available, ultra-violet light stabilised polyethylene, polypropylene, etc for the detachable net bag, stainless steel wire ropes and cables for the cable 18, cord 51, stainless steel or plastic for the pulleys 22 etc.

Whilst the invention has been described with reference to a number of preferred embodiments, it should be appreciated that the invention can be embodied in many other forms.

What is claimed is:

1. Apparatus for intercepting solid matter from a fluid flowing through a drain or pipe, the apparatus including:

coupling means for association with an outlet of the drain or pipe to receive and direct fluid flowing thereout;

netting means for intercepting the solid matter in the directed fluid and arranged with the coupling means such that fluid leaving the outlet can pass through the netting means; and a netting release means for interacting between the netting means and the coupling means, the netting release means being configured to automatically release the netting means from the coupling means responsive to a predetermined amount of solid matter being intercepted.

2. Apparatus as claimed in claim 1 wherein, as a result of restricted fluid flow caused by intercepted solid matter, the netting release means is operable to automatically release the netting means from the coupling means responsive to one or more of the following:

(i) a predetermined level of fluid being reached;

(ii) a predetermined pressure of fluid being reached;

(iii) a predetermined mass of solid matter being reached; or (iv) the flow of fluid being reduced to a predetermined level.

3. Apparatus as claimed in claim 2 wherein the netting release means is activated by a trip mechanism associated with the coupling means, responsive to one or more of the following:

(i) activation by the rise of a float;

(ii) activation by a mechanical, electronic or electrical sensor; and (iii) activation responsive to a level of fluid flow being recorded by a flow meter.

4. Apparatus as claimed in claim 3 wherein the netting release means includes a retaining cable means that extends around an outer periphery of the coupling means and releasably clamps an end of the netting means thereagainst;

whereby in use, de-tensioning of the cable means enables the release of the netting means from the coupling means.

5. Apparatus as claimed in claim 4 including a float that is retained within a riser pipe such that, at a predetermined level of fluid, the float rises to a height in the riser pipe whereby it activates a mechanical release device, and this in turn acts on the cable means to de-tension the same, thereby enabling release of the netting means from the coupling means.

6. Apparatus as claimed in claim 5 wherein the mechanical release device includes a pivot arm mounted at one end to the coupling means for pivoting thereabouts and being adapted at the opposite end for engagement by a catch mechanism that is part of and is released in the mechanical release device, so that the cable means is released from the coupling means when the pivot arm is allowed to move away from the catch mechanism.

7. Apparatus as claimed in claim 6 wherein the cable means is provided in the form of an endless loop and is looped around the pivot arm in use when the pivot arm is engaged by the catch mechanism.

8. Apparatus as claimed in claim 7 wherein the cable means is looped around and attached to the periphery of an opening to the netting means and is adapted, when the netting means is released from the coupling means, to act as a drawstring to close an opening of the netting means.

9. Apparatus as claimed in claim 8 wherein the netting means is a net bag and is additionally attached to the coupling means by a safety cord or chain.

10. Apparatus as claimed in claim 1 wherein the safety cord or chain is attached to the cable means and, when the netting release means is released from the coupling means, pulls on the cable means to cause it to close the opening to the netting means.

11. Apparatus as claimed in any one of the preceding claims wherein the coupling means also includes a diversion outlet through which fluid flowing through the apparatus is diverted in use.

12. Apparatus as claimed in claim 11 wherein the diversion outlet is a diversion pipe that is selectively closed to fluid flow by an associated valving mechanism, wherein the valving mechanism can be opened once the predetermined amount of solid matter has been intercepted by the netting means, to then release fluid via the diversion pipe.

13. Apparatus as claimed in claim 11 wherein the diversion outlet is a vent formed in the coupling means and which is adapted for allowing an overflow of fluid to be released from the apparatus once a predetermined fluid level has been reached in the coupling means.

14. Apparatus for intercepting solid matter from a fluid flowing through a drain or pipe, the apparatus including:

coupling means for association with an outlet of the drain or pipe to receive and direct fluid flowing thereout;

netting means for intercepting the solid matter in the directed fluid and arranged with the coupling means such that fluid leaving the outlet can pass through the netting means; and a netting release means for interacting between the netting means and the coupling means, the netting release means being configured to automatically release the netting means from the coupling means responsive to a predetermined amount of solid of solid matter being intercepted, wherein, as a result of restricted fluid flow caused by intercepted solid matter, the netting release means is operable to automatically release the netting means from the coupling means responsive to one or more of the following:

(i) a predetermined level of fluid being reached;

(ii) a predetermined pressure of fluid is being reached;

(iii) a predetermined mass of solid matter being reached; or (iv) the flow of fluid being reduced to a predetermined level, and wherein the netting release means is activated by a trip mechanism associated with the coupling means, responsive to one or more of the following:

(i) activation by the rise of a float;

(ii) activation by a mechanical, electronic or electrical sensor; and (iii) activation responsive to a level of fluid flow being record by a flow meter.

15. Apparatus for intercepting solid matter from a fluid flowing through a drain or pipe, the apparatus including:

coupling means for association with an outlet of the drain or pipe to receive and direct fluid flowing thereout;

netting means for intercepting the solid matter in the directed fluids and arranged with the coupling means such that fluid leaving the outlet can pass through the netting means; and a netting release means for interacting between the netting means and the coupling means, the netting release means being configured to automatically release the netting means from the coupling means responsive to a predetermined amount of solid matter being intercepted, wherein, as a result of restricted fluid flow caused by intercepted solid matter, the netting release means is operable to automatically release the netting means from the coupling means responsive to one or more of the following:

(i) a predetermined level of fluid being reached;

(ii) a predetermined pressure of fluid is being reached;

(iii) a predetermined mass of solid matter being reached; or (iv) the flow of fluid being reduced to a predetermined level, wherein the netting release means is activated by a trip mechanism associated with the coupling means, responsive to one or more of the following:

(i) activation by the rise of a float;

(ii) activation by a mechanical, electronic or electrical sensor; and (iii) activation responsive to a level of fluid flow being recorded by a flow meter, and wherein the netting release means includes a retaining cable means that extends around an outer periphery of the coupling means and releasably clamps an end of the netting means thereagainst, whereby in use, de-tensioning of the cable means enables the release of the netting means from the coupling means.

16. Apparatus as claimed in claim 15 including a float that is retained within a riser pipe such that, at a predetermined level of fluid, the float rises to a height in the riser pipe whereby it activates a mechanical release device, and this in turn acts on the cable means to de-tension the same, thereby enabling release of the netting means from the coupling means.

17. Apparatus as claimed in claim 16 wherein the mechanical release device includes a pivot arm mounted at one end to the coupling means for pivoting thereabouts and being adapted at the opposite end for engagement by a catch mechanism that is part of and is released in the mechanical release device, so that the cable means is released from the coupling means when the pivot arm is allowed to move away from the catch mechanism.

18. Apparatus as claimed in claim 17 wherein the cable means is provided in the form of an endless loop and is looped around the pivot arm in use when the pivot arm is engaged by the catch mechanism.

19. Apparatus as claimed in claim 18 wherein the cable means is looped around and attached to the periphery of an opening to the netting means and is adapted, when the netting means is released from the coupling means, to act as a drawstring to close an opening of the netting means.

20. Apparatus for intercepting solid matter from a fluid flowing through a drain or pipe, the apparatus including:

coupling means for association with an outlet of the drain or pipe to receive and direct fluid flowing thereout, the coupling means including a vent formed in the coupling means through which fluid flowing through the apparatus is diverted in use, the vent being adapted for allowing an overflow of fluid to be released once a predetermined fluid has been reached in the coupling means;

netting means for intercepting the solid matter in the directed fluids and arranged with the coupling means such that fluid leaving the outlet can pass through the netting means; and a netting release means for interacting between the netting means and the coupling means, the netting release means being configured to automatically release the netting means from the coupling means responsive to a predetermined amount of solid matter being intercepted.

* * * * *